United States Patent [19]

Crandall

[11] Patent Number: 4,808,773

[45] Date of Patent: Feb. 28, 1989

[54] LOW IMPEDANCE CABLE

[75] Inventor: Earl F. Crandall, Windham, N.H.

[73] Assignee: Digital Equipment Corporation, Maynard, Mass.

[21] Appl. No.: 103,832

[22] Filed: Oct. 1, 1987

[51] Int. Cl.[4] ..... H01B 11/00

[52] U.S. Cl. ..... 174/113 R; 29/831; 333/238; 439/496; 439/498

[58] Field of Search ..... 174/113 R; 361/303, 361/308, 328, 407; 333/238, 246; 439/492, 496, 498; 29/831

[56] References Cited

U.S. PATENT DOCUMENTS

| | | | |
|---|---|---|---|
| 269,735 | 12/1882 | Speicher | 174/113 R |
| 1,217,890 | 2/1917 | Fortescue | 174/143 |
| 1,702,993 | 2/1929 | Brown | 174/143 |
| 1,952,925 | 3/1934 | Kopinski | 361/308 |
| 2,155,060 | 4/1939 | Phillips | 174/113 R |
| 2,915,808 | 12/1959 | Clemons | 361/303 |
| 2,969,488 | 1/1961 | Foster et al. | 361/308 |
| 3,260,972 | 7/1966 | Pusch | 333/238 |
| 3,991,451 | 11/1976 | Maruyama et al. | 361/323 X |
| 4,363,162 | 12/1982 | Price | 361/323 |
| 4,439,811 | 3/1984 | Sasaki et al. | 361/323 X |
| 4,502,096 | 2/1985 | Malone | 361/308 |

*Primary Examiner*—Morris H. Nimmo

*Attorney, Agent, or Firm*—Hayes, Soloway, Hennessey & Hage

[57] ABSTRACT

A cable for use in ultra-low impedance electrical interconnections and a connector for optional use therewith. A two-conductor version of the cable is formed, for example, by the steps of, disposing an elongated first strip of electrical conductor on an elongated first strip of electrical insulator; disposing an elongated second strip of electrical insulator on the first strip of electrical conductor; disposing an elongated second strip of electrical conductor on the second strip of electrical insulator; and, winding the strips in combination from one side to the other to form the cable as a spiral in cross section. The electrical conductors can comprise elongated rectangular sheets of metal foil or, alternatively to provide a cable of increased flexibility, a plurality of wires disposed side-by-side along the length of the associated strip of electrical insulator.

6 Claims, 4 Drawing Sheets

LOW IMPEDANCE CABLE

BACKGROUND OF THE INVENTION

The present invention relates to electrical cables and, more particularly, to a multiconductor cable for ultra-low impedance electrical interconnections. The invention has particular utility for use in audio applications and will be described in connection with such utility, although other uses are contemplated.

Cables used in low impedance applications such as connecting power supplies to loads and audio amplifiers to speakers can suffer with respect to their performance capabilities in critical applications due to three factors—inductance, capacitance, and skin effect. All these factors are frequency dependent and result in, basically shifts in the time of arrival of the components of a signal as a function of frequency. For audiophiles who are into true high fidelity performance, such frequency shifting due to, for example, skin effect in the interconnecting cables can result in what is perceived as a muddied signal to the listener. In such applications, it has been typical to employ cables such as the coaxial cable 10 of FIG. 1. Coaxial cable 10 has a central conductor 12 surrounded by a core of insulating material 14 over which is disposed an outer conductor 16 covered by insulation 18. The outer conductor 16 is typically a spirally wrapped metal foil or an encasing shield of wire braid. In applications of relatively low impedance, i.e., less than the standard 150 ohm lamp cord or 50 ohm transmission line, heavy cable such as that indicated as 22 in FIG. 3 or multi-strand heavy wire such as that indicated as 20 in FIG. 2 have been employed. In such low impedance applications, the emphasis has usually been on heavy gauge conductors such as those of FIGS. 2 and 3 as the best attempt to solve the problem.

While considering the problem of connecting dynamic loads to power supplies in a power supply test system as employed with computers manufactured by the assignee of this application, the applicant noted that an instantaneous step in the load current contained high frequency harmonics and that employing traditional cables resulted in the cable inductances being high enough that power supplies would fail a step response test due to the transient created by the cabling. Applicant first considered applying strip-line techniques as employed in high frequency applications such as microwave and radar to the problem. The major drawback to such an approach was that many layers would be needed and that the forming (bending) of such a conductor would be very difficult. Cables used for interconnecting must be bendable and, preferably, even flexible in use.

Wherefore, it is the object of the present invention to provide a low impedance cable for use in ultra-low impedance applications having predetermined inductance, capacitance, and skin effect characteristics.

It is another object of the present invention to provide such a cable which is bendable and possibly even flexible in use.

It is still another object of the present invention to provide a connector system for use with the cable.

Other objects and benefits of the present invention will become apparent from the detailed description which follows hereinafter taken in conjunction with the drawing figures which accompany it.

SUMMARY

The foregoing objects have been achieved in the ultra-low impedance cable of the present invention which, for example, is formed as a two-conductor cable by the method comprising the steps of, disposing an elongated first strip of electrical conductor on an elongated first strip of electrical insulator; disposing an elongated second strip of electrical insulator on the first strip of electrical conductor; disposing an elongated second strip of electrical conductor on the second strip of electrical insulator; and, winding the strips in combination from one side to the other to form the cable as a spiral in cross section.

According to one embodiment, the steps of disposing a strip of electrical conductor comprise disposing an elongated rectangular sheet of metal foil on the associated strip of electrical insulator while according to another embodiment providing added flexibility to the resultant cable, the steps of disposing a strip of electrical conductor comprise disposing a plurality of wires side-by-side along the length of the associated strip of electrical insulator.

The preferred embodiment also includes a connector for the cable comprising with respect to the two conductor embodiment, for example, a flat body portion, the body portion having a spiral contact attachment member extending downward from one side thereof and communicating with a contacting portion on the opposite side having spaced first and second electrical contacts for electrical connection thereto, the contact attachment member comprising a spiral insulator having a first contact member along one side thereof communicating with the first electrical contact and a second contact member along the other side thereof communicating with the second electrical contact whereby the contact attachment member can be interposed between the electrical conductors and the electrical insulators of the cable along the length of the spiral thereof at an end of the cable with the first and second electrical conductors disposed over the contact member with the first electrical contact making electrical contact with the first electrical conductor and the second electrical contact making electrical contact with the second electrical conductor.

In the preferred connector, there are clamping means for surrounding the contact attachment member and the electrical conductors and the electrical insulators of the cable when they are interconnected and for clamping them physically and electrically together under a radially inward clamping force.

DESCRIPTION OF THE PREFERRED EMBODIMENTS

Figure 1:
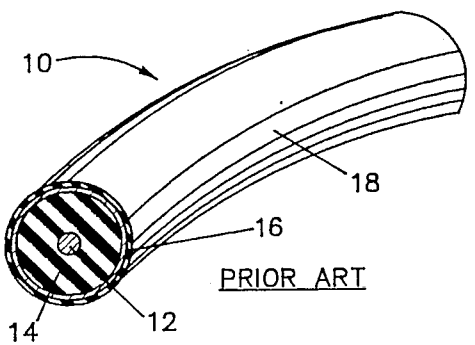
FIG. 1 is a perspective end view of a prior art coaxial cable.
Figure 2:
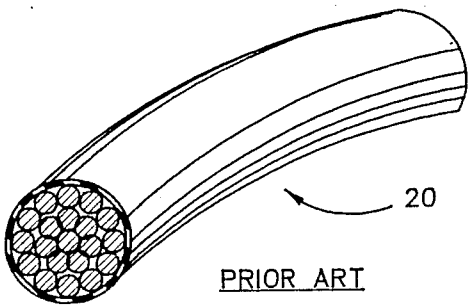
FIG. 2 is a perspective end view of a prior art heavy cable.
Figure 3:
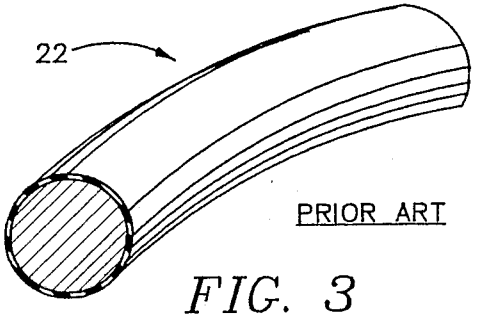
FIG. 3 is a perspective end view of a prior art heavy wire.
Figure 4:
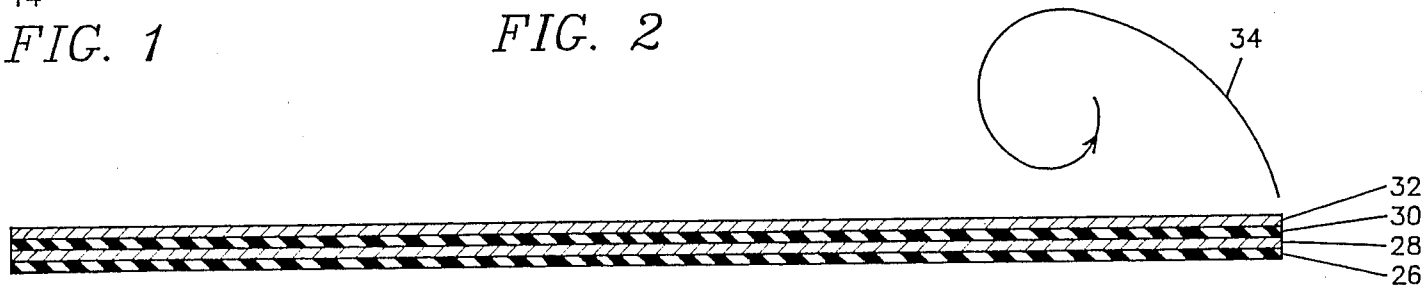
FIG. 4 is an end view of the components of the present invention in a preferred embodiment prior to their being rolled into a spiral cable.
Figure 5:
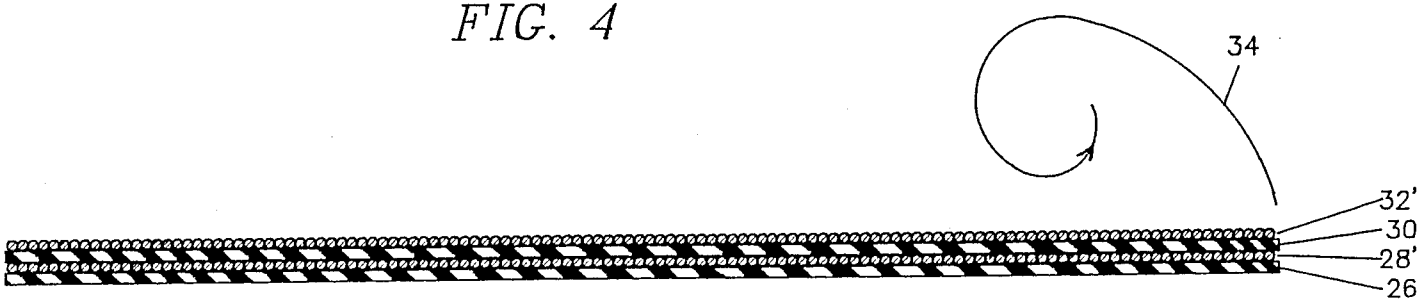
FIG. 5 is an end view in the manner of FIG. 4 showing an alternate embodiment wherein a plurality of individual conductors replaces metal foil conductor material to provide added flexibility to the cable of the present invention.
Figure 6:
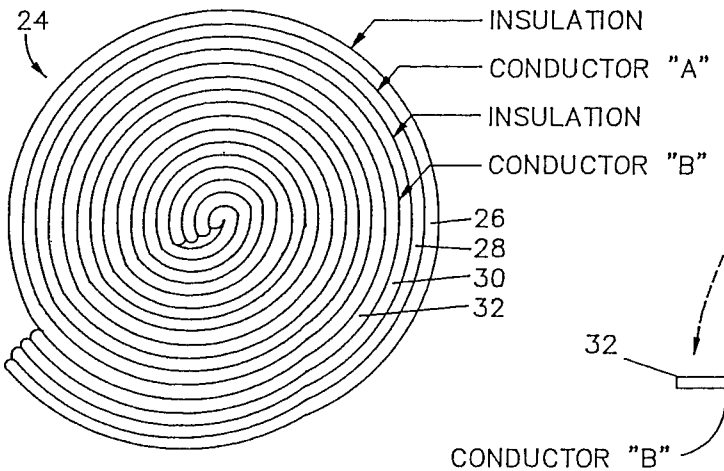
FIG. 6 is an end view of the embodiment of FIG. 4 following the material being spiraled into a cable.

The cable of the present invention and its manner of formation can best be understood with reference to FIGS. 4–6. The cable 24 is, in essence, a variation of strip-line technology. Essentially, it can be defined as a single, very wide, flat, strip transmission line which is rolled lengthwise to form a tubular-shaped, very low impedance transmission line which is formable with processes similar to rigid coax or pipe.

To form a two-conductor cable as applicable in most applications, the structure of FIG. 4 is first assembled. As will be appreciated by those skilled in the art, if a three (or more) conductor cable was desired, added layers would simply be added prior to rolling. For simplicity, the example to be described herein is a two conductor cable. There is a bottom sheet of insulation 26 which, following assembly, will become the outer layer of the cable 24. On top of bottom insulation 26 is a bottom conductor 28 having a top sheet of insulation 30 thereon followed by a top conductor 32. In one tested embodiment, the conductors 28, 32 were of copper foil 0.003 inches in thickness and the insulation 26, 30 was 0.002 inches in thickness for a total thickness of 0.01 inches per layer. One preferred insulation is polyvinylidenefluoride. Other insulated materials well known in the art could, of course, be employed. If more flexibility of the resultant cable is desired, the sheet conductors 28, 32 can be replaced by a plurality of individual wires 28′, 32′ placed side-by-side as shown in FIG. 5. If employed, the wires 28′, 32′ can be laid onto the sulation 26, 30 longitudinally or at an angle so as to be spiraled throughout the resultant cable 24.

Once the materials have been assembled as in FIG. 4 or 5, the cable 24 is formed by rolling the materials lengthwise from one side toward the other as indicated by the arrows 34 to form the spiral construction shown in end view in FIG. 6. The layers can be bonded together with an adhesive or in other manners well known to those skilled in the art as, for example, encasing within an outer heat-shrinkable tubing. The performance characteristics of several embodiments of the present invention are shown in Table 1.

TABLE 1

| Outside Diameter | Layer | Equiv Width | Current Rating | μfd /ft | PHry /ft | Impedance μ-Ohms |
|---|---|---|---|---|---|---|
| 1/16" | 4 | .5 | 5 A | .001 | 6900 | 1670 |
| ⅛" | 9 | 2 | 20 A | .005 | 1600 | 375 |
| ¼" | 18 | 7 | 80 A | .02 | 390 | 94 |
| ⅜" | 27 | 16 | 180 A | .04 | 170 | 42 |
| ½" | 36 | 28 | 320 A | .08 | 96 | 23 |
| ¾" | 54 | 64 | 710 A | .17 | 43 | 10 |
| 1.0" | 71 | 112 | 1250 A | .30 | 24 | 6 |

Figure 7:
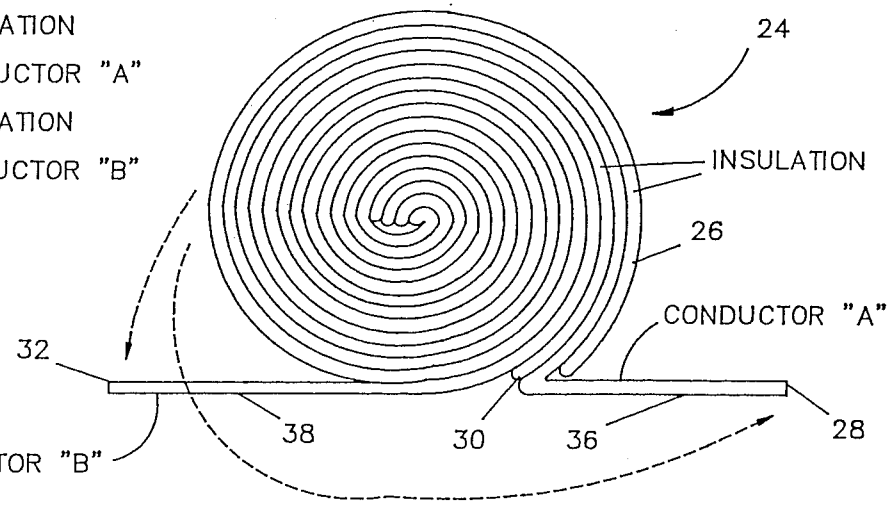
FIG. 7 is an end view of the cable of FIG. 6 showing one manner of forming connecting tabs on the end of the cable wire for electrical attachment thereof.
Figure 8:
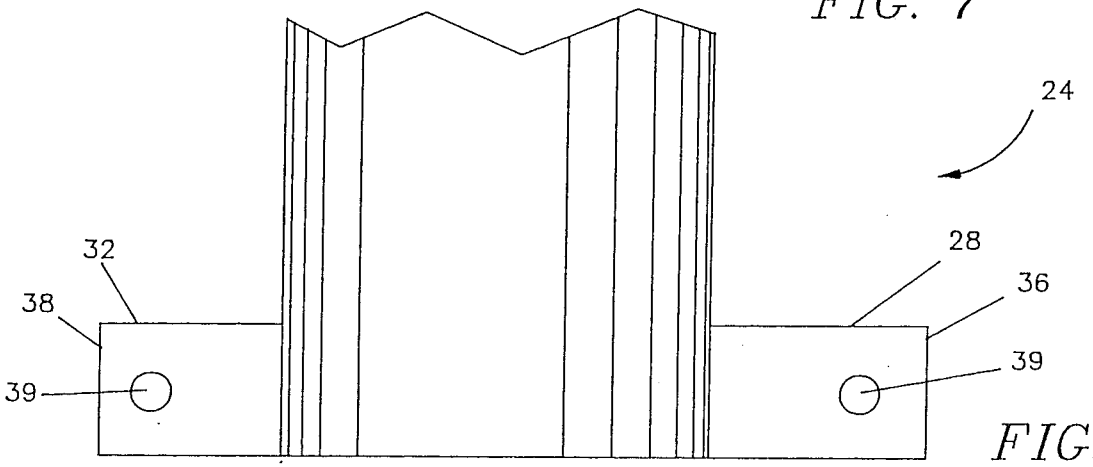
FIG. 8 is a top view of the cable of FIG. 7.
Figure 9:
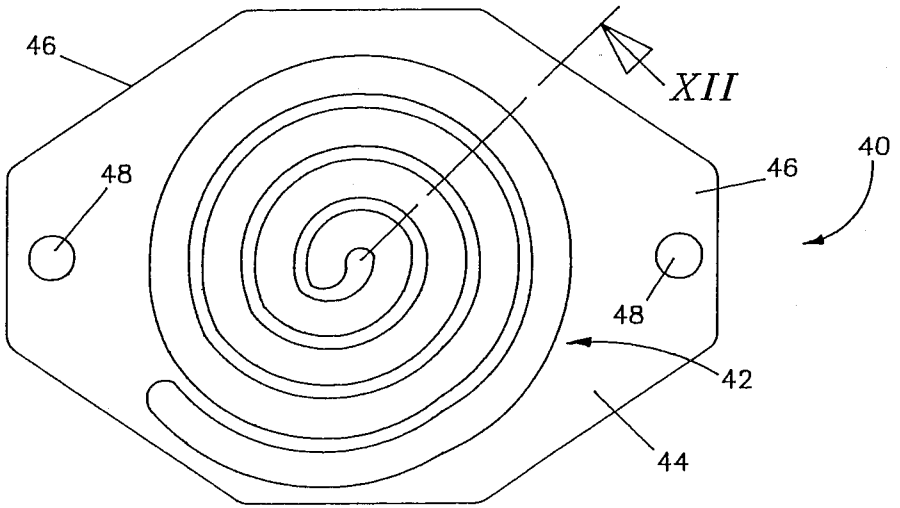
FIG. 9 is a top view of a male connector according to the present invention for use with the cable hereof.
Figure 10:
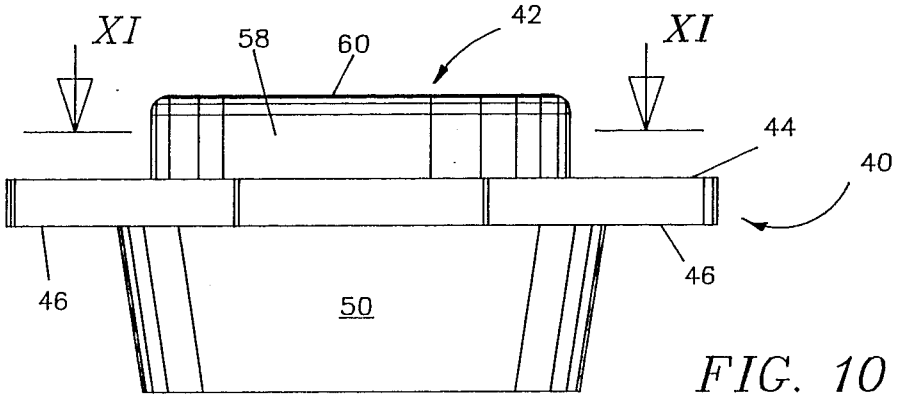
FIG. 10 is a side view of the connector of FIG. 9.
Figure 11:
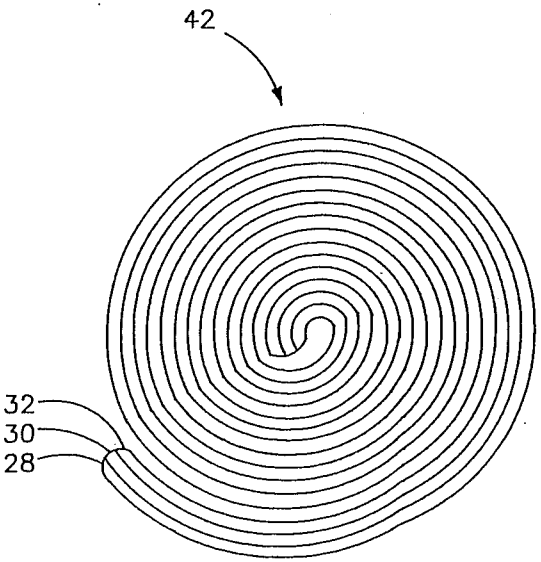
FIG. 11 is a cutaway view through the connector of FIG. 10 in the plane XI—XI.
Figure 12:
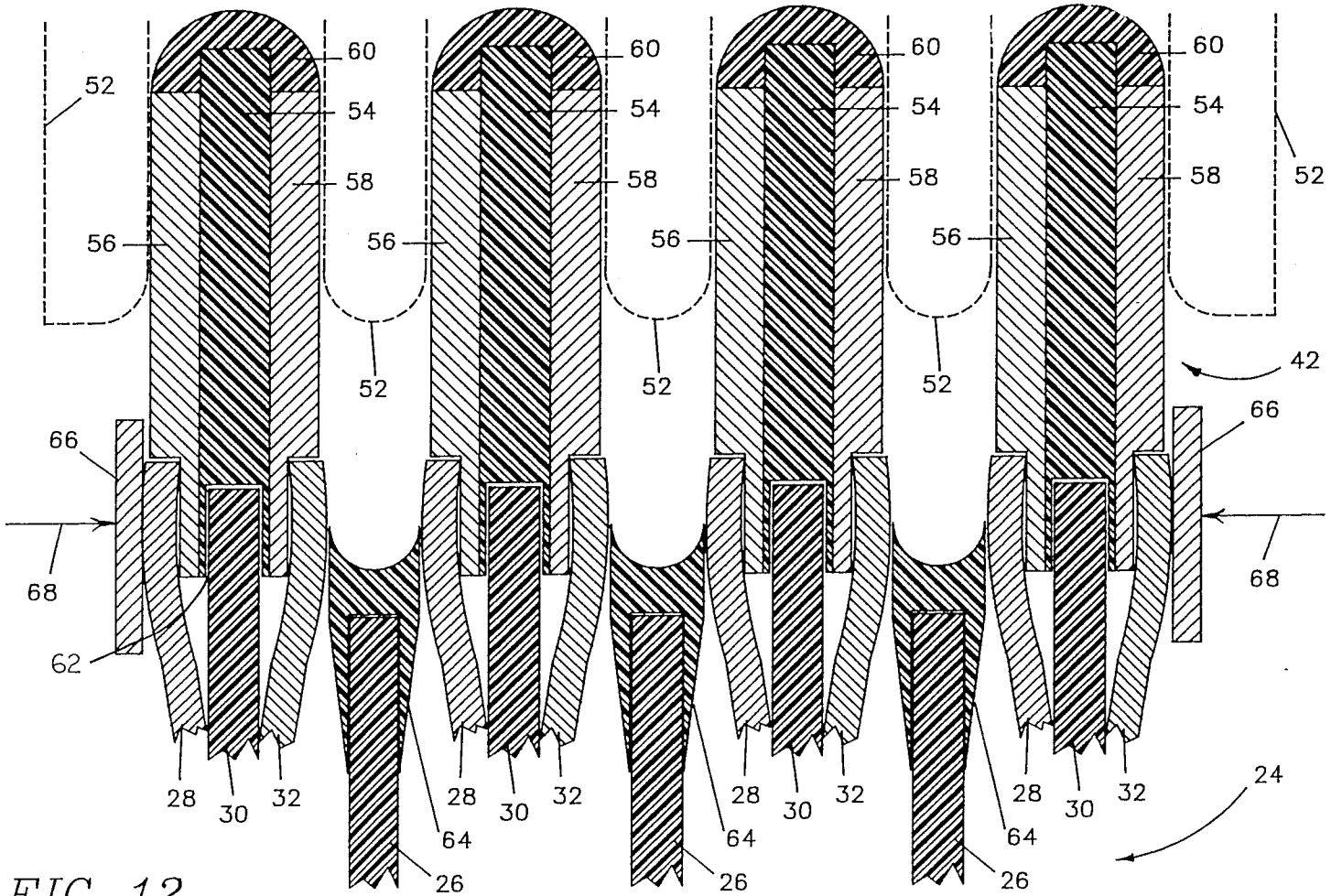
FIG. 12 is a detailed cross-section of the male contact spiral of the connector of FIG. 9 in the plane indicated by the line XII.

In its simplest form, attachment to the conductors 28, 32 of cable 24 can be accomplished in the manner shown in FIGS. 7 and 8. The outer conductor 28 (the former bottom conductor now designated as conductor "A") is preferably employed as the ground or neutral conductor while the inner conductor 32 (the former top conductor now designated as conductor "B") is intended for use as the signal conductor. At a point of intended attachment, the layers comprising 26, 28, 30 and 32 are sliced through and the materials unwrapped to form tabs 36, 38 as shown in the figures. The insulation 26, 30 is cut away to provide access to the conductors 28, 32 forming the tabs 36, 38, respectively. If the tabs 36, 38 are formed adjacent an end of the cable 24 as shown in FIGS. 7 and 8, the layers need only be cut at one point. If the tabs 36, 38 are formed intermediate the ends, two parallel cuts through the layers must be made. As those skilled in the art will recognize, a cable 24 according to the present invention is particularly suited for adaption to a bus-type computer application since a plurality of the tabs 36, 38 can be formed along the length of the cable 24 to affect attachment thereto at a plurality of spaced points.

Turning now to FIGS. 9–12, a connector for use with the cable of the present invention, either in addition to or in lieu of the tab technique described above, is shown. A male connector is shown and generally indicated as 40. Those skilled in the art will recognize that the matching female connector can be constructed in a manner readily understood without the necessity of a detailed description thereof being included. Accordingly, in the interest of simplicity and the avoidance of redundancy, only the male connector 40 will be described.

Connector 40 comprises a spiral male member 42 adapted to be inserted into a mating female member. The male member 42 is carried by a mounting plate 44 having tabs 46 extending therefrom through which there are holes 48 to be employed for fastening the connector 40 in place with screws, or the like, in a manner well known. A protective shroud 50 (rigid or flexible, as desired) is disposed on the opposite side of the mounting plate 44 from the male member 42. The cable 24 is inserted into the shroud 50, which surrounds the mating portions of the connector 40 best seen with reference to FIG. 12. As depicted in detail therein, the spiral male member 42 is adapted to fit in mating relationship with a female member, as represented by the dashed lines 52. Along its length, the male member 42 comprises a central core 54 of insulated material such as plastic having a first contact material 56 along one side thereof and a second contact material 58 along the other side thereof. Preferred construction for the contact material 56, 58 would be as is typical of most high quality connectors employed in such applications wherein a basic contact material of conductive metal is covered with a precious metal such as gold to prevent corrosion at the contacting surfaces. The central core 54 and contact materials 56, 58 are coverered with a curved, insulating, protective crown piece 60 to protect the contact materials 56, 58, prevent contact with the ends thereof, and facilitate the insertion of the male member 42 into a mating spiral groove in the female connector.

As presently envisioned, the connector 40 will be of a diameter approximately one and one-half times that of the cable 24. The components 26, 28, 30, and 32 of the cable 24 must first be spread radially outward and separated for insertion into the connecting bottom portion of the male member 42 shown in FIG. 12. It is anticipated that an appropriate tool will be developed to effect the cutting and spreading operations necessary to allow assembly of the cable 24 to the male member 42 in the manner shown in FIG. 12. As depicted therein, the conductors 28, 32 are disposed over the first and second contact materials 56, 58, respectively, and the insulation 30 between the two conductors 28, 32 is disposed within a slot 62 in the central core 54 provided therefore. The insulation 26 is cut shorter than insulation 30 and a spiral insulating spacer 64 is disposed over the end thereof. The entire assembly can then be held physically and electrically together by a surrounding clamping band 66 which compresses everything radially inward as indicated by the arrows 68.

As those skilled in the art will recognize, the term "spiral" as employed and described herein could include repeated folding. That is, instead of tightly rolling the components as depicted hereinbefore to form a cable of generally circular cross section, the components could be folded over and over from one side to the other to form a cable which is of more or less rectangular cross section (with rounded corners) within the scope and spirit of the present invention.

Wherefore, having thus described my invention, I claim:

1. A cable for transmitting, with minimum distortion, signals having high frequency components, said cable having ultra low impedance and comprising a first elongated electrical conductor layer, a first elongated electrical insulator layer, a second elongated conductor layer, a second elongated electrical insulator layer, said electrical conductor layers comprising a plurality of wires disposed side-by-side in electrical contact along the length of a said elongated electrical insulator layer, said layers being superposed and wound in a spiral to form an elongated conductor with said first conductor layer being inside of said second conductor layer and constituting the signal conductor, and electrical connections at each end of said elongated conductors for each of said first and second conducting layers.

2. The cable of claim 1 wherein:

said plurality of wires are disposed parallel to the edges of said electrical insulator layers.

3. The cable of claim 1 wherein:

said plurality of wires are disposed at an angle to the edges of said electrical insulator layers.

4. The method of forming a cable for transmitting, with minimum distortion, signals having high frequency components for ultra-low impedance electrical interconnections comprising the steps of:

(a) disposing an elongated first electrical conductor layer comprising a plurality of wires side-by-side in electrical contact on and along the length of an elongated first electrical insulator layer;

(b) disposing an elongated second electrical insulator layer on the first electrical conductor layer;

(c) disposing an elongated second electrical conductor comprising a plurality of wires side-by-side in electrical contact on and along the length of the second elongated electrical insulator layer;

(d) winding the layers in combination from one side to the other to form the cable as a spiral in cross section; and (e) forming electrical connections at each end of said first and second elongated electrical conductors for each of the two conducting layers.

5. The method of forming a cable of claim 4 wherein:

said step of disposing a plurality of wires comprises disposing the plurality of wires parallel to the edges of the associated said electrical insulator layer.

6. The method of forming a cable of claim 4 wherein:

said step of disposing a plurality of wires comprises disposing the plurality of wires at an angle to the edges of the associated said electrical insulator layer.

* * * * *